US011071380B2

(12) United States Patent
Rihtarec

(10) Patent No.: US 11,071,380 B2
(45) Date of Patent: Jul. 27, 2021

(54) GUIDE RAIL OF A GUIDE SYSTEM, GUIDE SYSTEM, AND FURNITURE ITEM

(71) Applicant: Grass GmbH, Hoechst (AT)

(72) Inventor: Filip Rihtarec, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/207,687

(22) Filed: Dec. 3, 2018

(65) Prior Publication Data

US 2019/0166994 A1 Jun. 6, 2019

(30) Foreign Application Priority Data

Dec. 4, 2017 (DE) ..... 10 2017 128 750.7

(51) Int. Cl.

| | |
|---|---|
| ***A47B 88/427*** | (2017.01) |
| ***A47B 88/477*** | (2017.01) |
| ***A47B 88/483*** | (2017.01) |
| ***A47B 88/43*** | (2017.01) |
| ***A47B 88/49*** | (2017.01) |

(52) U.S. Cl.

CPC ..... *A47B 88/427* (2017.01); *A47B 88/43* (2017.01); *A47B 88/477* (2017.01); *A47B 88/483* (2017.01); *A47B 88/49* (2017.01); *A47B 2210/0059* (2013.01)

(58) Field of Classification Search

CPC ..... A47B 88/40; A47B 88/43; A47B 88/49; A47B 88/423; A47B 88/427; A47B 88/477; A47B 88/483

USPC ..... 312/330.1, 334.1, 334.4, 334.6, 334.8

See application file for complete search history.

(56) References Cited

U.S. PATENT DOCUMENTS

| | | | | |
|---|---|---|---|---|
| 5,470,144 A * | 11/1995 | Wen | A47B 88/493 312/330.1 |
| 5,641,216 A * | 6/1997 | Grass | A47B 88/483 312/334.27 |
| 7,396,092 B2 * | 7/2008 | Prentner | A47B 88/487 312/334.6 |
| 2004/0104649 A1 * | 6/2004 | Muller | A47B 88/467 312/333 |

(Continued)

FOREIGN PATENT DOCUMENTS

| | | | |
|---|---|---|---|
| DE | 20 2013 012 141 U1 | 6/2015 | |
| JP | 8-318379 * | 12/1996 | B23K 15/00 |
| WO | 2017/202048 A1 | 11/2017 | |

OTHER PUBLICATIONS

German Search Report (Application No. 10 2017 128 750.7) dated Oct. 10, 2018.

*Primary Examiner* — James O Hansen
(74) *Attorney, Agent, or Firm* — Burr & Brown, PLLC

(57) ABSTRACT

A guide rail of a guide system for a push-in element is proposed, wherein the guide rail comprises a rail body and a fastening element, wherein the fastening element is configured in such a way as to fasten the guide rail on a mating portion in the state of use of the guide system, wherein the fastening element is mounted on the rail body and cohesively bonded thereto, and wherein the fastening element has a flat material portion with opposite main sides and with a narrow front edge portion between the main sides. According to the invention, in the state with the fastening element connected to the rail body, the edge portion of the fastening element abuts a surface side on the rail body, which surface side is oriented upright in the state of use of the guide rail.

16 Claims, 5 Drawing Sheets

(56) References Cited

U.S. PATENT DOCUMENTS

| | | | | |
|---|---|---|---|---|
| 2004/0104650 | A1* | 6/2004 | Egger | A47B 88/467<br>312/333 |
| 2011/0012492 | A1* | 1/2011 | Radusin | A47B 88/43<br>312/334.8 |

* cited by examiner

GUIDE RAIL OF A GUIDE SYSTEM, GUIDE SYSTEM, AND FURNITURE ITEM

This application claims the benefit under 35 USC § 119(a)-(d) of German Application No. 10 2017 128 750.7 filed Dec. 4, 2017, the entirety of which is incorporated herein by reference.

FIELD OF THE INVENTION

The present invention relates to a guide rail of a guide system, a guide system and a furniture item.

BACKGROUND OF THE INVENTION

Guide rails or guide systems for a push-in element, in particular, a push-in element of a furniture item or of a domestic appliance, e.g. a kitchen appliance, are known in different designs.

For example, so-called partial-extension mechanisms with two guide rails, or full-extension mechanisms with three guide rails, are used as guide systems in a pull-out unit, wherein the rails are movable in a mutually telescopic manner.

A push-in element, for example, a drawer, a shelf base, a food tray or the like, is generally received in a displaceable manner by way of exactly two separate, identical structural units of a partial-extension mechanism or of a full-extension mechanism. The respective structural unit of the pull-out guides is preferably fastened to an inner face of a furniture cabinet or of a housing of a domestic appliance or kitchen appliance.

Since a guide system or a guide rail has to satisfy stringent demands in terms of technology and economy, optimizations are necessary to this end.

SUMMARY OF THE INVENTION

The object of the present invention is to further improve the aforementioned guide rails, and the guide systems formed with these, and to further improve their production and also the corresponding items of furniture and domestic appliances, for example, kitchen appliances, particularly in terms of technical and economic aspects and with regard to automated and material-saving production. The guide or guide rail is intended to be of a compact design and to be able to support comparatively high mechanical loads.

The present invention proceeds from a guide rail of a guide system for a push-in element, for example, a drawer, in particular, for a push-in element of a furniture item or of a domestic appliance, for example, a kitchen appliance, wherein the guide rail comprises a rail body and a fastening element, wherein the fastening element is configured in such a way as to fasten the guide rail on a mating portion in the state of use of the guide system, wherein the fastening element is mounted on the rail body and connected thereto, and wherein the fastening element has a flat material portion with opposite main sides and with a narrow front edge portion between the main sides. The guide rail is accordingly a fixed rail or cabinet rail which, in the state of use, is secured in a fixed position on the mating portion, for example, a cabinet unit, by means of the fastening element.

In particular, the present invention relates to a furniture element guide rail or to a guide rail of a furniture element guide system or to a guide rail of a furniture partial-extension mechanism or of a furniture full-extension mechanism.

In the production of the guide rail, the rail body and the fastening element are each made available from a separate prefabricated element, and these elements are fixedly connected to each other to produce the guide rail. The fastening element is preferably produced from an originally two-dimensional flat material or sheet material, e.g. a sheet metal material or steel plate, by a shaping process such as a bending process. The rail body can correspondingly be produced from a sheet metal or, for example, can be a rolled, extruded or pressed metal profile. The fastening element, which is also designated as adapter bracket or mounting bracket, is preferably brought to its final angled basic form from what is initially an at least approximately rectangular two-dimensional sheet metal material, inter alia by a punching process and a cold forming process. In the basic form, the fastening element is preferably L-shaped and has two limbs arranged at an angle to each other, in particular, at a right angle to each other.

The rail body is the part of the guide rail which interacts with a further guide rail such as a central rail or a push-in element rail or with bearing means of the guide system that act between the rails.

The core concept of the present invention is that, in the state with the fastening element connected to the rail body, the edge portion of the fastening element abuts a surface side on the rail body, which surface side is oriented upright in the state of use of the guide rail. The fastening element is mounted on the rail body by preferably being cohesively connected thereto. The fastening element preferably comprises two limbs which are connected to each other along a bend line and are oriented at an angle to each other. The fastening element is preferably formed in one piece from a sheet metal material.

The guide rail or the rail body preferably has a surface side which is upright or oriented perpendicularly in the state of use and which, in the state of use, is directed toward the mating portion such as an inner face of a side wall of a cabinet unit. The surface side is, in particular, a lengthwise side or a side extending preferably in a strip shape over all or most of the length of the rail body, e.g. a side wall of the guide rail or of the rail body. The vertically oriented surface side on the rail body or the side wall of the rail body is preferably an outer face of a, for example, cross-sectionally L-shaped or U-shaped rail body or of a wall of a cross-sectionally tetragonal or polygonal rail body.

It is advantageous that the fastening element is designed symmetrically. Preferably, the fastening element is, in particular, designed with mirror symmetry. The fastening element is advantageously symmetrical to a plane of symmetry which is perpendicular to the two limbs of the fastening element and passes through the center axis of the fastening element, wherein this center axis, in the state of connection to the rail body, is with reference to the direction of the longitudinal axis of the rail body, i.e. defines the center of the fastening element in the longitudinal direction of the rail body or of the guide rail. This direction coincides with the direction of the bend line via which the two limbs of the fastening element are at an angle to each other.

It is advantageous that the fastening element can be used identically both as a front or rear fastening element on a guide rail and also for a right-hand guide system structural unit or a right-hand partial-extension or full-extension structural unit or for a left-hand guide system structural unit or a left-hand partial-extension or full-extension structural unit. This is economically advantageous, particularly in terms of the production, delivery, storage and processing of the fastening element. Only one embodiment of the fastening element is required that can be used universally.

It is advantageous that the connection of the fastening element to the rail body is provided exclusively by the abutting connection of the edge portion of the fastening element to the surface side on the rail body. This is advantageous from the point of view of manufacturing technology.

It is also advantageous that the fastening element is configured in the basic form as a bracket element with two limbs oriented at an angle to each other, wherein one limb has the flat material portion with the opposite main sides and with the narrow edge portion. The fastening element can thus be easily produced from a sheet metal material.

Hitherto, connecting the fastening element and the rail body required a comparatively large surface portion on the rail body on the one hand and a comparatively large surface portion on the fastening element. For the known connection of the fastening element to the rail body, the sheet metal portions in question are brought, in particular, into two-dimensional surface contact, overlapping each other, and connected to each other. The surface portions are thus in mutual contact and the two opposite sheet metal portions are connected, for example, by connection elements such as rivets or by a clinching connection method.

The present invention proposes an entirely different approach whereby only comparatively much smaller surfaces of the sheet metal portions on the rail body and on the fastening element are brought into contact with each other and welded to each other or, for example, adhesively bonded to each other or soldered to each other, preferably laser-welded to each other. The weld seam thus formed can run on both sides along the upper limit of the edge portion and/or along the lower limit of the edge portion. The weld seam at the top or bottom can preferably be continuous, for maximum stability of the connection, or can be interrupted along the length of the boundary profile of the edge portion.

The surface portions connected to each other according to the present invention amount to only a fraction of the surface areas which, in the known connections of guide rail and fastening element, come into contact with each other and are connected to each other. For example, in the guide rail according to the present invention, the size of the surface area required for the connection on a single fastening element is in the range of ca. 15 $mm^2$, and therefore the surface area required for the connection on the rail body is correspondingly ca. 15 $mm^2$. Two fastening elements of the same kind are thus provided on the guide rail.

By contrast, in known guide rails of a comparable kind with two fastening elements on the guide rail, a surface area required for the connection on a fastening element or on the rail body is of the order of ca. 120 $mm^2$. This surface area is provided, for example, by the upper face of a horizontal limb of the fastening element.

This means that the guide rail according to the present invention manages with a connection surface area amounting to only ca. 12% of the connection surface area of known guide rails. The surface area saved means, among other things, that the fastening element or a horizontal limb of the fastening element can be made smaller by this surface area. Thus, the present invention advantageously permits a saving in material and a corresponding reduction of weight, with respect to the fastening element. Accordingly, the extent of the horizontal limb of the fastening element, from the e.g. right-angled bend to the free end at which the edge portion is present with its front face, is comparatively much shorter than is the case in known fastening elements or adapter brackets.

In cross section, the fastening element preferably has an at least approximated L shape with, in the state of use, a horizontally oriented limb and a vertically oriented limb. At least one limb has, with respect to the plane formed by the limb, an elevated portion which is formed by deformation from the sheet material. With the elevated portion, a mechanical stiffening of the fastening element is advantageously achieved in relation to a flat or plane shape. The elevated portion is preferably formed substantially in the rail-body-side or horizontally oriented limb. The elevated portion preferably extends into the angle region and beyond the latter as far as the region of the other, vertical limb.

With a corresponding dimension of the rail-body-side limb, as regards its extent from the bend as far as the free end, a distance of the rail body from the mating portion is, in particular, defined, for example, from an inner face of a side wall of a furniture cabinet. Depending on the length of the rail-body-side limb, the possibility of connection of the fastening element to the rail body is predefined. The size or surface area of the other, cabinet-side limb of the fastening element determines the portion or the surface area of the fastening element that serves for fastening to the mating portion, e.g. the side wall of the furniture cabinet.

The thickness of the edge portion of the rail-body-side limb, i.e. the height of the front strip-shaped surface via which the abutting connection to the upright surface side of the rail body is realized, preferably corresponds to the material thickness of the flat material of the fastening element. The flat material or the shaped sheet metal material preferably has a thickness of between 0.4 and 1.5 millimeter. The material thickness of the fastening element is preferably 0.8 millimeter over substantially the entirety thereof. For the abutting connection, the edge portion has a front face which is plane or oriented at right angles to the two opposite main or flat sides of the fastening bracket. The surface of the edge portion, produced, for example, by a punching operation or by laser cutting of the sheet material, is accordingly flat or lies in one plane. The edge portion or the plane front face thereof is thus advantageously suitable to be connected two-dimensionally across the surface of the front face to the likewise plane surface side of the rail body. The mutually bearing surfaces of the front face of the edge portion of the fastening element, on the one hand, and of the surface side of the rail body, on the other hand, are therefore in contact across the whole surface, which is advantageous particularly for a cohesively bonded connection.

The vertically oriented limb of the fastening element advantageously has connection means or connection portions, e.g. through-openings such as screw holes, for screwing the fastening element, with the guide rail mounted thereon, onto a mating portion, for example, a side wall of a furniture cabinet.

Another advantage is to be seen in the fact that the edge portion of the fastening element, in abutting contact with the vertically oriented surface side on the rail body, has a strip-shaped configuration. The connection can be advantageously established via the strip-shaped configuration of the interconnected portions according to the profile of the edge portion. In particular, on the surface side, the connection to the edge portion can be established via a comparatively small surface area. This also gives rise to a large number of different possibilities for mounting the edge portion in accordance with its linear profile on the surface side. To put it another way, the fastening element can be chosen to be mounted in particular at different heights or at different vertical positions on the rail body or on the surface side thereof.

It is furthermore advantageous that the shape of the edge portion is predefined by the shape of the flat material portion of the fastening element adjoining the edge portion. In particular, the shape of the edge portion can be influenced by an embossing in the associated horizontal limb of the fastening element. The shape of the edge portion relates to the linear profile over the length of the edge profile or looking frontally or perpendicularly to the plane of the narrow front face of the edge profile. In the case of a simple L-shaped fastening element made from a flat sheet metal which is bent at right angles, the shape of the edge portion is a straight line. If, for example, an embossing such as a depression or elevation is present in the horizontal limb of the fastening element, then, on account of the embossing, the shape of the edge portion is drawn upward or downward according to a curve for example, deviating from the straight line according to the plane limb without embossing.

An advantageous modification of the present invention is characterized in that the flat material portion adjoining the edge portion comprises a region that is depressed and/or elevated in relation to adjacent regions of the flat material portion. This is advantageous from mechanical aspects, in particular with respect to static and dynamic loads which act on the guide rail and are introduced into the mating portion via the fastening element. The depressed and/or elevated region, for example a bead or hollow, is preferably upwardly offset with respect to the state of use on the relevant limb of the fastening element connected to the rail body. The upwardly deformed or offset region preferably has an oblique material portion which drops away from the other limb toward the edge portion or is configured in the manner of a ramp, of which the upper face is plane but inclined.

The stabilizing or stiffening of the fastening element, achieved with the depressed and/or elevated region, is advantageous in the state of use, for example, if a drawer with a relatively large storage volume on the associated guide system is heavily laden, whereby in addition to the weight of the empty drawer an additional mass of over 50 kilograms, for example, may be added. The considerable bending loads and/or torsional loads that act on the guide system as a result of this are taken up via the one fastening element or the preferably two fastening elements and transmitted to the mating portion or a side wall of a cabinet unit. Two or more fastening elements are preferably present on a guide rail, i.e. on a structural unit of a partial-extension or full-extension mechanism. Drawers are generally received in a displaceable manner on the cabinet unit by way of two structural units of a partial-extension or full-extension mechanism, i.e. a structural unit on each long side of the drawer.

It is also advantageous that the flat material portion adjoining the edge portion in each case has a lateral region, wherein the two lateral regions lie on a common plane, and an elevated flat material region is present between the two lateral regions. In relation to a front view, this is perpendicular to the front face of the edge portion. In this view, the edge profile resembles a section through a hat or a "hat shape", wherein the lateral regions are assigned to a brim, and the elevated flat material region is assigned to the crown of the hat. Compared, for example, to a straight linear shape of the edge portion, i.e. when the limb in the state of use is a plane horizontal surface, it is possible to achieve, with the same expenditure in terms of material, a particularly stable or more mechanically load-bearing guide rail or a more highly loadable connection between the fastening element and the surface side of the rail body.

Another advantageous embodiment of the present invention is characterized in that the edge profile has mutually offset straight portions, which are connected to one another by a shoulder present between the straight portions. The straight portions comprise, for example, two lower-lying straight portions and one straight portion upwardly offset in relation to these. The transition between two straight portions can be polygonal or curved. Such shaping also increases the stability of the guide rail and of the guide system.

It is additionally advantageous if the rail body is configured as a hollow profile enclosed by wall portions of the rail body. The hollow profile is preferably slotted or open at the top in the state of use. The hollow profile preferably has an underside or a plane lower horizontal wall portion which is adjoined, along both longitudinal edges, by a preferably perpendicular wall portion protruding upward at a right angle in the state of use. The at least one fastening element is fixedly connected to the outside of one of the perpendicular wall portions. Each of the two perpendicular wall portions is adjoined at the upper edge thereof, over the at least substantial length of the rail body, by an upper web portion angled inward at, for example, 45 degrees. The free ends of the two web portions run toward each other but remain separate from each other over a width distance, such that the rail body is open at its top with a longitudinal slit along its length. In the case of a full-extension mechanism, the volume enclosed by the rail body accommodates a central rail, wherein the central rail continues upward through the longitudinal slit. Moreover, a carriage with bearing bodies of bearing means is accommodated between walls of the hollow-profile rail body and walls of the central rail.

In relation to the height of the perpendicular wall portion forming the upright surface side of the rail body, two subregions of the edge portion or of its narrow front faces are preferably mounted in the lower region and one subregion slightly farther up on the upright surface side. The lower limit of the lower two subregions of the edge portion is preferably offset slightly upward relative to the lower edge of the perpendicular wall portion and therefore to the underside of the horizontal wall portion of the rail body. Thus, the underside of the horizontal limb of the fastening element is advantageously offset slightly upward in relation to the underside of the rail body or of the horizontal wall portion.

The underside of the horizontal limb of the fastening element and the underside of the horizontal wall portion may also be flush.

If the edge portion, in a front view of the edge portion, has a hat-shaped profile with two lateral subregions and one elevated central subregion, the elevated central subregion of the edge portion is offset slightly upward on the perpendicular wall portion or the upright surface side of the rail body compared to the lateral subregions of the edge portion.

According to an advantageous embodiment, at least two fastening elements are mounted on the rail body. Preferably, exactly two fastening elements are present on the rail body spaced apart from each other by a central length portion of the rail body. Thus, along the length of the guide rail, the latter can be fixed with sufficient stability on the mating portion. Preferably, one fastening element is provided in a rear end portion of the rail body and a further fastening element is provided in a front end portion of the rail body. The front fastening element is mounted on the rail body preferably with its front edge rearwardly offset by a slight distance from the front edge of the rail body. Moreover, the rear fastening element is mounted on the rail body preferably with its rear edge forwardly offset by a slight distance from the rear edge of the rail body.

It is also advantageous that the guide rail is formed from a shaped sheet material. In particular, the guide rail is produced by cold forming from an initially strip-shaped or rectangular sheet metal material.

The present invention is also directed to a guide system for a push-in element, in particular, a linear guide system for a push-in element of a furniture item or of a domestic appliance, for example, a kitchen appliance, wherein the guide system comprises a structural unit with precisely two guide rails, wherein the structural unit has a cabinet rail and a push-in element rail which is received displaceably on the cabinet rail and which is configured for connection to the push-in element, wherein a bearing arrangement is present between portions of the cabinet rail and portions of the push-in element rail for the purpose of a relative movement of cabinet rail and push-in element rail, wherein the cabinet rail is configured as the guide rail according to one of the abovementioned embodiments.

This concerns a guide system which is configured as a so-called partial-extension mechanism. The partial-extension mechanism thus has the advantages discussed above, in particular, as regards the stability of the guide system.

The present invention relates, in particular, to a guide system for furniture or a furniture push-in element guide system such as a furniture drawer guide system or a domestic appliance push-in element guide system, e.g. a kitchen appliance guide system. The bearing arrangement is on the one hand in contact with the cabinet rail and on the other hand in contact with the push-in element rail. As a bearing arrangement, it is possible in particular to use carriages with bearing bodies mounted thereon, in particular antifriction bearings.

The present invention is also directed to a guide system for a push-in element, in particular, a linear guide system for a push-in element of a furniture item or of a domestic appliance, for example, a kitchen appliance, wherein the guide system comprises a cabinet rail, a push-in element rail, which is configured for connection to a push-in element, and a central rail present between the cabinet rail and the push-in element rail, wherein, for the purpose of a relative movement between the rails, a bearing arrangement is present between portions of the cabinet rail and of the central rail and a bearing arrangement is present between portions of the central rail and of the push-in element rail, wherein the cabinet rail is configured as a guide rail according to one of the embodiments set out above. In this way, a so-called full-extension mechanism with telescopically displaceable rails is made available, wherein the abovementioned advantages can be realized on the guide system.

The present invention is directed, in particular, to a furniture push-in element guide system and a domestic appliance push-in element guide system, which is configured as a full-extension mechanism.

It is advantageous that the guide system is configured as an undermount guide system, wherein the push-in element rail is configured such that an underside of a base of the push-in element can be supported on the push-in element rail in the state of use of the guide system, preferably on an upper face of the push-in element rail. The lateral distance between an inner face of a cabinet side wall and the opposing adjacent side wall of the push-in element, e.g. a side wall of a drawer, can thus advantageously be kept to a minimum.

Finally, it is advantageous that the guide system is configured as a hollow-chamber drawer side guide system, wherein the guide system is configured in such a way that the guide system can be accommodated at least substantially within an internal volume of a hollow-chamber drawer side. The hollow-chamber drawer side is, in particular, designed as a bent sheet-metal structure for furniture drawers and has, in the lower region, a hollow space which is open from below such that substantial portions of the guide rail or of the guide system can be accommodated in a recessed position in the hollow chamber. This provides a particularly compact design. Only the fastening element and a narrow lower part of the cabinet rail, for example, are present outside the shell surface of the hollow-chamber drawer side.

The present invention further relates to a furniture item or domestic appliance, for example, a kitchen appliance, comprising a cabinet and a push-in element, wherein the push-in element is received movably on the cabinet by way of a guide system, wherein a guide system according to the invention is present for the push-in element in accordance with one of the embodiments discussed above. The advantages set out can thus be achieved for the furniture item or domestic appliance.

BRIEF DESCRIPTION OF THE DRAWINGS

Further features and advantages of the present invention are explained in more detail on the basis of the illustrative embodiments of the invention shown in the figures, in which.

DETAILED DESCRIPTION OF THE INVENTION

For corresponding elements of different illustrative embodiments, the same reference signs are used below in part.

Figure 1:
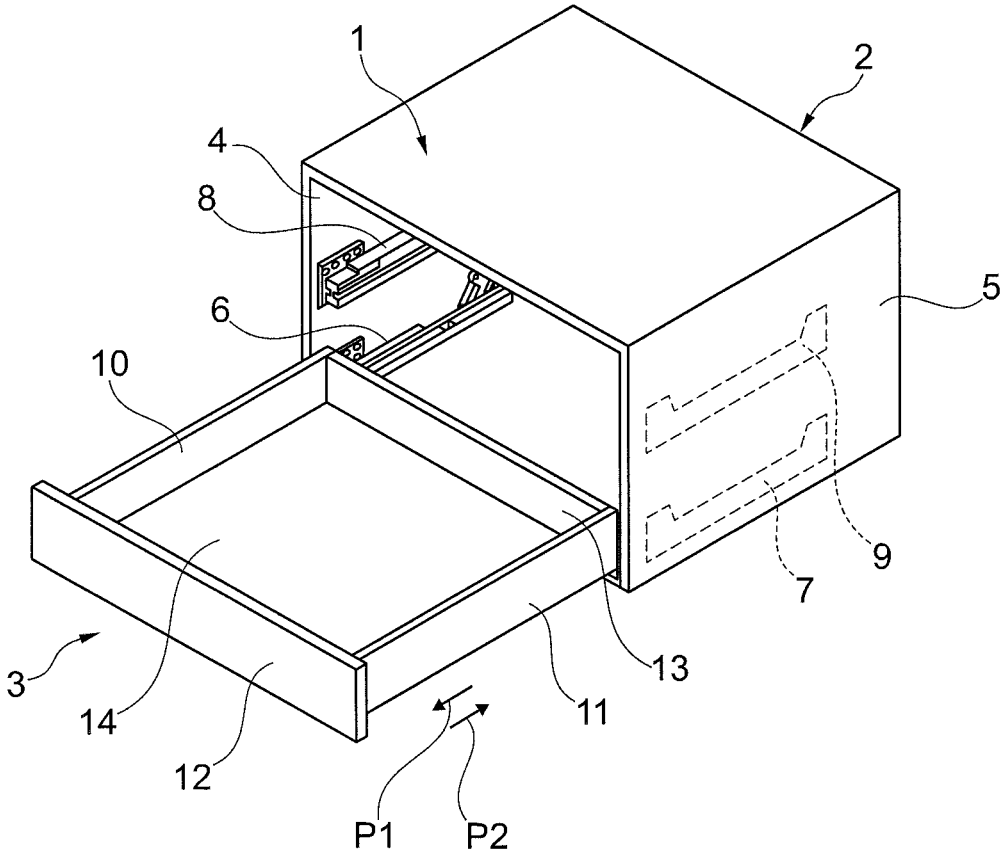
FIG. 1 shows a schematically depicted furniture item according to the present invention in a perspective view obliquely from above, with a drawer received displaceably thereon.

FIG. 1 shows a highly schematic depiction of a furniture item 1 according to the present invention in a state of use, with a hollow cuboid furniture cabinet 2 and a push-in element 3 configured as a drawer, wherein the drawer 3 is received displaceably on the furniture cabinet 2. The furniture cabinet 2 comprises two opposite vertical side walls 4 and 5 between which the drawer 3, starting from a state of accommodation in the interior of the furniture cabinet 2, can be pulled out in a horizontal direction according to P1 and then pushed in in an opposite direction according to P2 via a guide system according to the present invention with telescopic guide means or a first full-extension rail 6 and a second full-extension rail 7. The drawer 3 is shown in FIG. 1 in the state when moved out to the maximum extent or completely from the interior of the furniture cabinet 2. The storage volume of the drawer 3 can thus be accessed virtually unimpeded from above.

If the drawer 3 uses, instead of the full-extension rails 6, 7, in each case a partial-extension rail, the drawer 3, in the state of maximum extraction, cannot be moved so far out of the interior of the furniture cabinet 2 in direction P1 as is possible with the full-extension rails 6, 7 according to the depiction in FIG. 1. The front element 12 is then nearer to the open front face of the furniture cabinet 2 than is shown for the drawer 3 according to FIG. 1.

The full-extension rail 6 screwed onto the inner face of the side wall 4 is located opposite, and at the same height as, the full-extension rail 7 screwed onto the side wall 5. The full-extension rail 7 is concealed in FIG. 1 and is indicated by broken lines.

A further drawer (not shown in FIG. 1), guided correspondingly by way of full-extension rails 8 and 9, can be accommodated in the furniture cabinet 2 above the drawer 3.

The drawer 3 has mutually opposite drawer side walls 10, 11, each of which comprises a structured hollow-chamber drawer side. Moreover, the drawer 3 comprises a front element 12, a rear wall 13 lying horizontally opposite the latter, and a horizontally extending drawer base 14, which reaches as far as and is connected to the drawer side walls 10, 11, the front element 12 and the rear wall 13.

Figure 2:
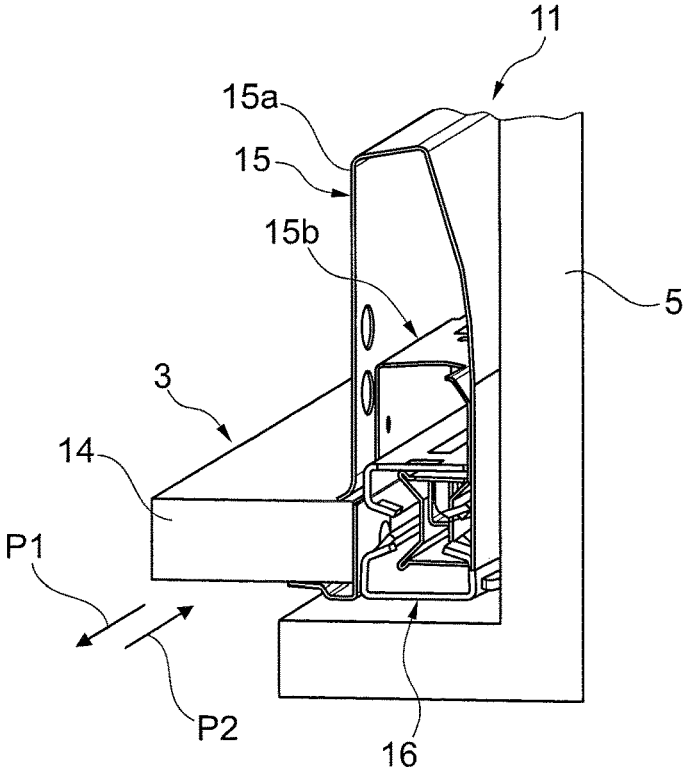
FIG. 2 shows in cross section a perspective detail of a furniture item according to the present invention, in the region of a drawer side adjacent to a furniture cabinet wall and a furniture cabinet base.
Figure 3:
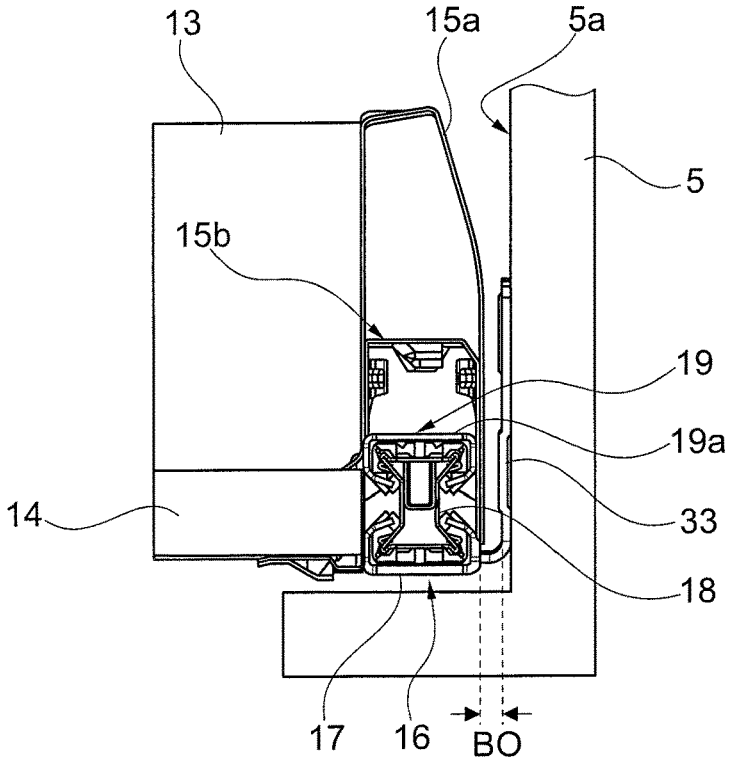
FIG. 3 shows the detail according to FIG. 2 in a front view.

FIGS. 2 and 3 show, in the region of a cabinet side wall 5, a detail of a drawer 3 with a drawer base 14, a drawer side wall 11 designed as a hollow-chamber drawer side 15, and a rear wall 13. The drawer 3 is received on the furniture cabinet 2 via two structural units of a guide system according to the present invention, i.e. on the side wall 5 via a full-extension rail 16 according to the present invention and in the same way on the side wall 4 (not visible in FIG. 2) via a further hollow-chamber drawer side of the drawer 3. It is received on the side wall 4 via a further structural unit or a further full-extension mechanism according to the present invention, as a result of which the drawer 3 is linearly displaceable horizontally in the directions P1 and P2.

The hollow-chamber drawer side 15, preferably made of bent sheet-metal material, has an outer housing 15*a* and an inner structure 15*b*, such that the full-extension mechanism 16 can be accommodated in a recessed manner in the internal volume of the hollow-chamber side wall 15. On an inner face of the hollow-chamber side wall 15 in the lower portion of the latter, it is designed to receive a longitudinal edge of the drawer base 14.

The full-extension mechanism 16 according to the present invention, formed as a structural unit of the guide system, comprises three mutually telescopic guide rails, namely a cabinet rail 17, a central rail 18 and a push-in element rail 19.

The central rail 18 is configured as a hollow profile according to the present invention.

Figure 4:
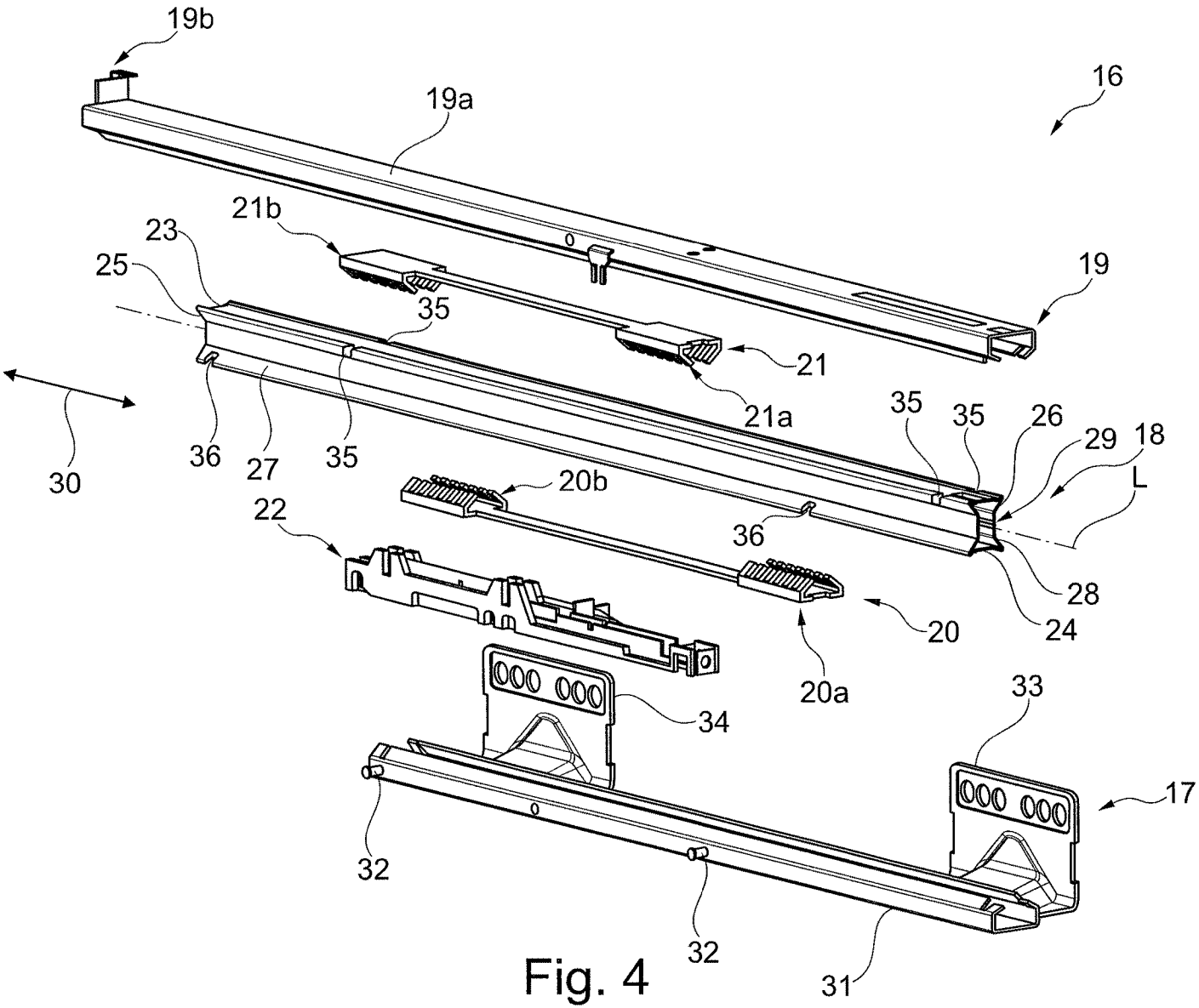
FIG. 4 shows an exploded view of a structural unit of a guide system according to the present invention.

A push-in element to be moved, for example, the drawer 3, is coupled or connected to the push-in element rail 19, for example, fixed to the hollow-chamber drawer side 15, whereas the cabinet rail is connected to the stationary part of the item of furniture. If the full-extension mechanism 16 is used as an undermount slide, an underside of a push-in element, or the base thereof, bears on an upper face 19*a* of the push-in element rail 19. An upwardly protruding hook element 19*b* at the rear end of the push-in element rail 19 forms a stop for a portion of a rear outer face of the push-in element, wherein, in order to achieve precise positioning, a portion of the hook element 19*b* angled parallel to the upper face 19*a* engages in a suitably prepared depression in the rear outer face of the push-in element. Thus, in FIG. 4, the rear region of the full-extension mechanism 16 is also fixed in the state of use (on the left-hand side in FIG. 4), and a front region of the full-extension mechanism 16 is fixed in the state of use (on the right-hand side in FIG. 4). A forward and rearward horizontal linear slide direction 30 of the rails 18 and 19, in the state of use of the full-extension mechanism 16, is indicated by a double arrow in FIG. 4.

Moreover, the full-extension mechanism 16 comprises a first or lower carriage 20 with bearing bodies arranged thereon, wherein the carriage 20 between the cabinet rail 17 and the central rail 18 ensures a load-transmitting relative movement of the rails 17, 18.

Moreover, the full-extension mechanism 16 comprises a second or upper carriage 21 with bearing bodies arranged thereon, wherein the carriage 21 between the central rail 18 and the push-in element rail 19 ensures a load-transmitting relative movement of the rails 18, 19.

Pins 32 are present on a vertical, inwardly facing narrow side of a rail body 31 of the cabinet rail 17, by way of which pins 32 a movement mechanism 22 of the full-extension mechanism 16 can be attached, for example, for ejection and/or retraction of the drawer 3.

Two L-shaped fastening elements 33 and 34 belong to the cabinet rail 17, wherein the fastening elements 33 and 34 serve to fasten or fix the full-extension mechanism 16 on an inner face of the side wall of a cabinet, for example, the inner face 5*a* of the side wall 5 of the furniture cabinet 2 of the furniture item 1.

In the illustrative embodiment according to FIG. 3, the fastening elements 33 and 34 have a horizontal limb greatly shortened in width with the width BO.

A distance between the outer face of the hollow-chamber drawer side 15 and an inner face 5*a* of the side wall 5 can thus be minimized, which maximizes a receiving volume of the drawer 3.

The guide rails 17, 18, 19 are preferably made of a sheet metal material which, starting from the flat sheet metal material, is shaped, for example, by a punching and bending process, in order to give the end product of the respective guide rail.

In order to limit a movement of the lower carriage 20 and of the upper carriage 21 relative to the central rail 18 in the longitudinal extent of the central rail 18 along a central longitudinal axis L (see FIG. 4), upper stops 35 and lower stops 36 are present on the central rail 18.

With the full-extension mechanism 16 assembled, the bearing bodies received on the carriages 20, 21 run along the outwardly directed sides of the central rail 18 or the horizontal wall portions 23, 24 and the side wall portions 25-28. By way of its portions 20*a* and 20*b* carrying the bearing bodies, the lower carriage 20 engages externally around the horizontal wall portion 24 and the side wall portions 27, 28.

By way of its portions 21*a* and 21*b* carrying the bearing bodies, the upper carriage 21 engages externally around the horizontal wall portion 23 and the side wall portions 25, 26.

Accordingly, the respective associated bearing bodies of the lower carriage 20 roll on the distal face of the lower horizontal wall portion 24, on the outer face of the side wall portion 27, and on the outer face of the side wall portion 28.

The respective associated bearing bodies of the upper carriage 21 roll on the distal face or the outer face of the upper horizontal wall portion 23, on the outer face of the side wall portion 25, and on the outer face of the side wall portion 26.

The bearing bodies of the carriages 20, 21 are preferably outwardly cylindrical bearing bodies or antifriction bearings such as bearing rollers or bearing needles.

The central rail 18, formed from an originally plane flat sheet of metal, is formed as a hollow profile and has along its length, according to the longitudinal axis L, a cohesively bonded connection or a welded connection or a narrow weld seam 29. The weld seam 29, preferably produced by a continuous laser method, connects, on one side of the central rail 18, narrow abutting edges of a lower subregion and an upper subregion of the central rail 18.

The hollow profile shape of the central rail 18 permits a central rail 18 that is mechanically highly stable, in particular, one that is flexurally and torsionally rigid.

In view of its configuration, the central rail 18 is additionally compact and saves on space and material.

The fastening element 33 is connected to the rail body 31 by cohesive bonding, preferably by a welding process such as a laser welding process.

In the illustrative embodiment according to FIGS. 2 to 9, there are precisely two identical fastening elements 33, 34 present on the rail body 31 of the cabinet rail 17. The basic shape of the fastening elements 33, 34 is an L shape. The statements made below concerning the fastening element 33 apply accordingly to the fastening element 34.

Figure 5:
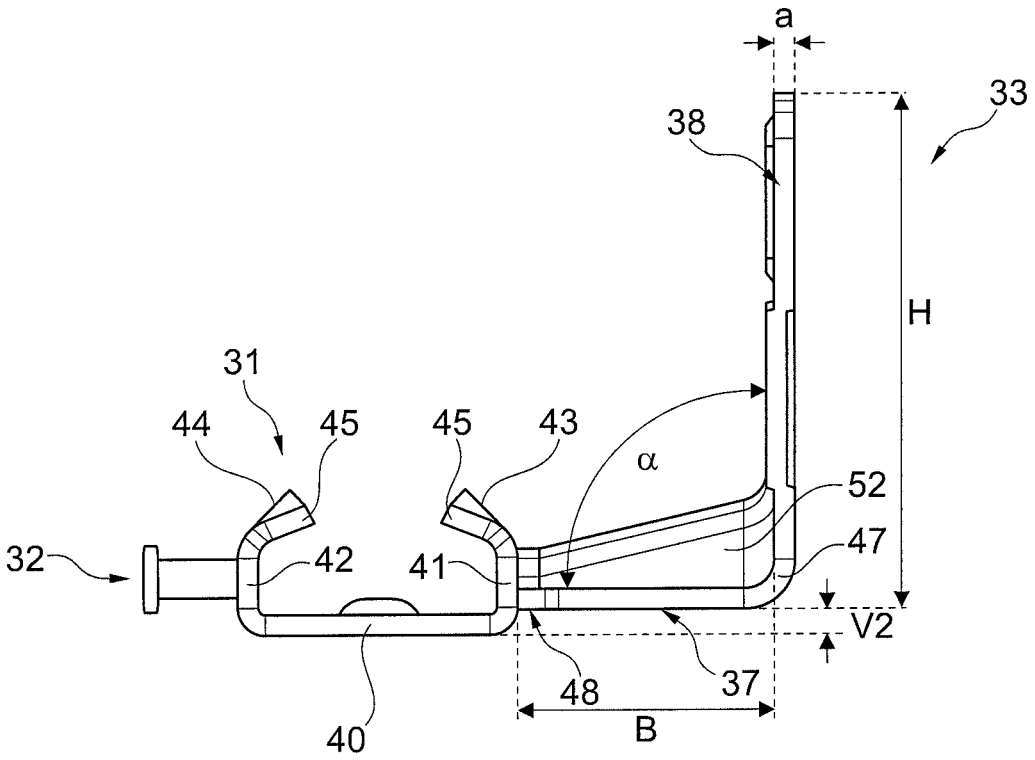
FIG. 5 shows a front view of one of the guide rails shown in FIG. 4.
Figure 8:
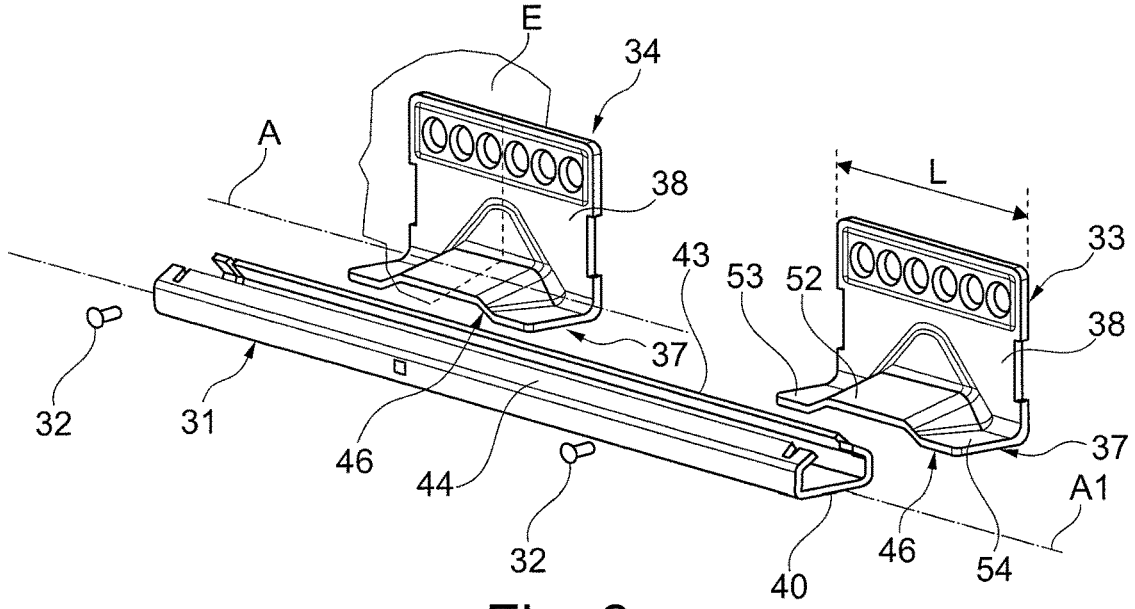
FIG. 8 shows the guide rail from FIGS. 5 to 7 in the view according to FIG. 4, in the state before connection of the elements of the guide rail.

In relation to the state of use, the fastening element 33 has a length L and a height H and, compared to the fastening element 33 shown in FIG. 3, a greater width B (see FIGS. 5 and 8). The material thickness or sheet metal thickness a (see FIG. 5) of the material of the fastening element 33 is, for example, in the range of preferably ca. 1 to ca. 1.5 millimeter. The width of the rail body 31 is comparable to the width B of the fastening element 33.

The double-limbed fastening element 33 has a limb 37 oriented horizontally in the state of use of the full-extension mechanism 16, and a vertical limb 38. The vertical limb 38 and the horizontal limb 37 preferably enclose an angle $\alpha$ of 90 degrees with their two-dimensionally spanned main plane. The fastening element 33 is mirror-symmetrical to the mirror symmetry plane E (see FIG. 8) which is transverse or perpendicular to the longitudinal axis A of the fastening element 33 and bisects the fastening element 33 exactly at half the length thereof. The longitudinal axis A of the fastening element 33 is parallel to the longitudinal axis of the full-extension mechanism 16 and to the longitudinal axis A1 of the rail body 31.

In the upper portion of the vertical limb 38, six mounting holes 39 are positioned alongside one another along the longitudinal extent of the fastening element 33, for example, screw holes to permit screwing onto a mating portion, e.g. the vertical side wall 5 of the furniture cabinet 2.

The rail body 31 comprises a base portion 40, perpendicular wall portions 41 and 42 arranged along both longitudinal sides of the base portion 40 and angled upward at a right angle in cross section, and longitudinal webs 43, 44 which, at the upper end of the associated wall portion 41, 42, respectively, are angled inward with respect to the wall portion 41, 42.

Moreover, at the front end and rear end of the rail body 31, two stops 45 are each formed by bent-over tongues on the longitudinal webs 43, 44.

By way of a front edge portion 46, which belongs to an edge 48 of the horizontal limb 37, the fastening element 33 is connected by abutment to the rail body 31. The edge 48 defines a free end of the limb 37, which is remote from a bend 47 of the fastening element 33. The edge portion 46 is formed by a plane, narrow front face of the edge 48 at right angles to the upper face and lower face of the horizontal limb, which constitute opposite surface sides.

Figure 9:
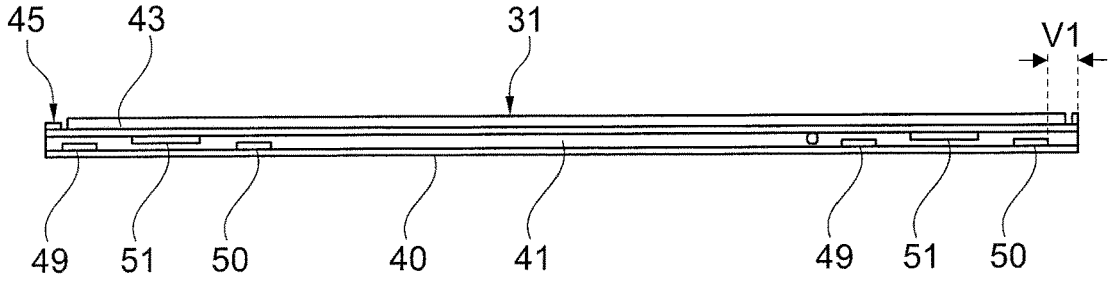
FIG. 9 shows the rail body according to FIG. 8 in a side view.

The edge portion 46 abuts the vertical wall portion 41, or the vertical outer face thereof. By way of this abutting contact, the fastening element 33 is welded to the wall portion 41. The welding is carried out across the weld regions 49, 50 and 51 as seen in FIG. 9.

The fastening element 33 and the rail body 31 are connected to each other along the edge portion 46, which is approximately hat-shaped in a front view.

The edge portion 46, with its hat shape when viewed from the front, is composed of two lateral flat regions 53, 54 and, located between these, an upwardly deformed or raised region 52, which extends as far as the bend 47 or as far as the vertical limb 38. The upper face of the region 52 at the horizontal limb 37 falls away from the vertical limb 38 toward the free edge 48 or is oriented at a slight slope.

Advantageously, according to the different heights at the edge portion 46, this therefore results in two different heights of the weld regions 49, 50, on the one hand, and of the weld region 51, on the other hand, externally on the wall portion 41, where the edge portion 46 is connected by welding. At a height lying farther below, the two portions of the edge portion 46 that are formed laterally with respect to the region 52 are connected to the weld regions 49 and 50. The portion of the edge portion 46 belonging to the region 52 is connected to the weld region 51 at a height located farther above on the wall portion 41.

Figure 6:
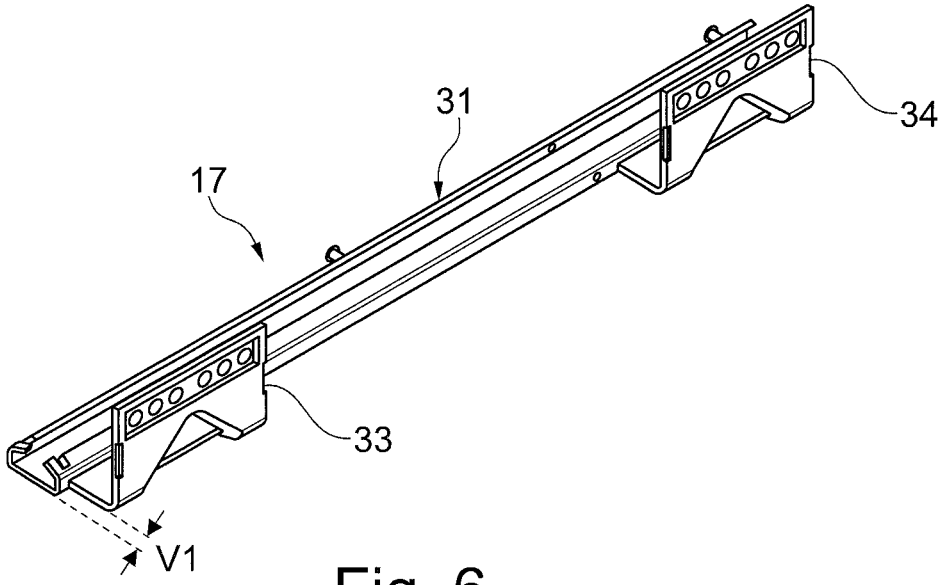
FIG. 6 shows the guide rail according to FIG. 5 in a perspective view obliquely from above.
Figure 7:
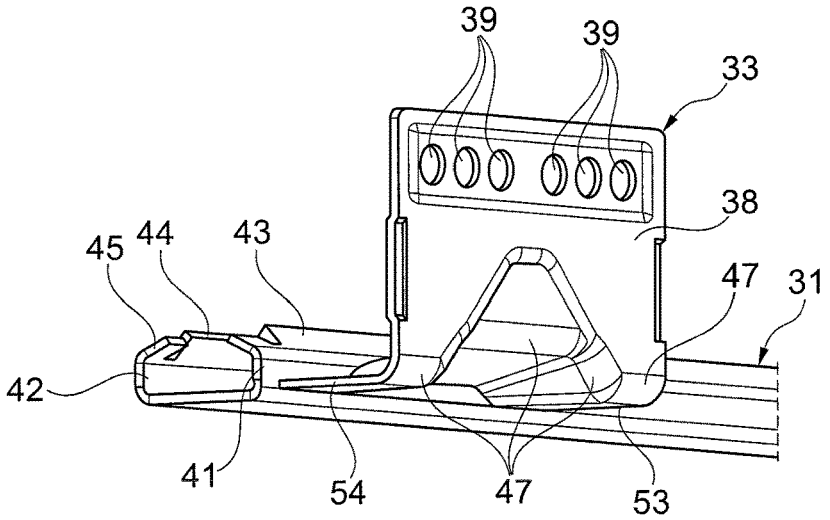
FIG. 7 shows a perspective view of an end portion of the guide rail according to FIGS. 5 and 6.

The fastening elements 33, 34 are set back from the end of the rail body 31 by the distance or offset V1 (see FIG. 6). An underside of the limb 37 and an underside of the base portion 40 have an offset V2. The offsets V1, V2 are advantageous from the point of view of manufacturing technology and for stability reasons.

LIST OF REFERENCE SIGNS

1 furniture item
2 furniture cabinet
3 drawer
4 side wall
5 side wall
5*a* inner face
6 full-extension rail
7 full-extension rail
8 full-extension rail
9 full-extension rail
10 drawer side wall
11 drawer side wall
12 front element
13 rear wall
14 drawer base
15 hollow-chamber drawer side
15*a* housing
15*b* inner structure
16 full-extension mechanism
17 cabinet rail
18 central rail
19 push-in element rail
19*a* upper face
19*b* hook element
20 carriage
20*a* portion
20*b* portion

21 carriage
21*a* portion
21*b* portion
22 movement mechanism
23 horizontal wall portion
24 horizontal wall portion
25 side wall portion
26 side wall portion
27 side wall portion
28 side wall portion
29 weld seam
30 sliding direction
31 rail body
32 pin
33 fastening element
34 fastening element
35 stop
36 stop
37 limb
38 limb
39 mounting hole
40 base portion
41 wall portion
42 wall portion
43 longitudinal web
44 longitudinal web
45 stop
46 edge portion
47 bend
48 edge
49 weld region
50 weld region
51 weld region
52 region
53 flat region
54 flat region

The invention claimed is:

1. A guide rail of a guide system for a push-in element, the guide rail comprising: a rail body having a horizontal base portion and at least one vertical side wall portion defining a vertical direction orthogonal to the base portion, and a fastening element mounted on the rail body, the fastening element including a substantially flat horizontal portion with at least one lateral region defining at least first and second front edge portions, the at least the second front edge portion being spaced away in the vertical direction from the at least the first front edge portion, wherein the at least the first and second front edge portions of the fastening element abut and are connected to the at least one vertical side wall portion on the rail body.

2. The guide rail according to claim 1, wherein connection of the fastening element to the rail body is provided exclusively by a cohesive bond defined between the abutting at least the first and second front edge portions of the fastening element and the side wall portion of the rail body.

3. The guide rail according to claim 1, wherein the fastening element is configured in a basic form as a bracket element with two limbs oriented orthogonal to each other.

4. The guide rail according to claim 1, wherein an edge portion of the fastening element, which comprises the at least the first and second front edge portions, and which abuts the side wall portion of the rail body, is strip-shaped.

5. The guide rail according to claim 1, wherein a shape of the at least the first and second front edge portions is predefined by a shape of the flat horizontal portion of the fastening element adjoining the edge portions.

6. The guide rail according to claim 1, wherein the flat horizontal portion adjoining the at least first and second front edge portions each comprise a region that is one of depressed or elevated in relation to adjacent regions of the flat horizontal portion.

7. The guide rail according to claim 1, wherein the flat horizontal portion adjoining the at least the first and second front edge portions in each case has the at least one lateral region, wherein the at least one lateral region includes two spaced apart lateral first regions provided on a common plane, and a raised lateral second region of elevated configuration defined between the two lateral first regions.

8. The guide rail according to claim 1, wherein an edge profile has mutually offset straight portions, which are connected to each other by a raised region present between the straight portions.

9. The guide rail according to claim 1, wherein the rail body is configured as a hollow profile enclosed by wall portions of the rail body.

10. The guide rail according to claim 1, wherein at least two fastening elements are mounted on the rail body.

11. The guide rail according to claim 1, wherein the guide rail is formed from a shaped sheet material.

12. A guide system for a push-in element, comprising: a structural unit including a guide rail according to claim 1, and a push-in element rail received displaceably on the guide rail, and configured for connection to the push-in element, wherein a bearing arrangement is present between portions of the guide rail and portions of the push-in element rail for the purpose of a relative movement of the guide rail and the push-in element rail.

13. The guide system according to claim 12, wherein the guide system is configured as an undermount guide system, wherein the push-in element rail is configured such that an underside of a base of the push-in element can be supported on the push-in element rail in the state of use of the guide system.

14. The guide system according to claim 12, wherein the guide system is configured as a hollow-chamber drawer side guide system, wherein the guide system is configured in such a way that the guide system can be accommodated at least substantially within an internal volume of a hollow-chamber drawer side.

15. A furniture item or domestic appliance, comprising a guide system according to claim 12.

16. A guide system for a push-in element comprising: a guide rail according to claim 1, a push-in element rail configured for connection to the push-in element, and a central rail present between the guide rail and the push-in element rail, wherein, a first bearing arrangement is present between portions of the guide rail and of the central rail and a second bearing arrangement is present between portions of the central rail and of the push-in element rail.

* * * * *